United States Patent [19]

Tanifuji et al.

[11] 4,137,742

[45] Feb. 6, 1979

[54] INTERSTAND TENSION CONTROL METHOD AND APPARATUS FOR TANDEM ROLLING MILL

[75] Inventors: Shinya Tanifuji; Yasuo Morooka, both of Hitachi, Japan

[73] Assignee: Hitachi, Ltd., Japan

[21] Appl. No.: 866,834

[22] Filed: Jan. 4, 1978

[30] Foreign Application Priority Data

Jan. 7, 1977 [JP] Japan ..... 52-388

[51] Int. Cl.[2] ..... B21B 37/00

[52] U.S. Cl. ..... 72/6; 72/19

[58] Field of Search ..... 72/6–8, 72/19, 16, 14, 21

[56] References Cited

U.S. PATENT DOCUMENTS

| | | | |
|---|---|---|---|
| 3,457,747 | 7/1969 | Yeomans | 72/19 |
| 3,807,208 | 4/1974 | Hensleigh | 72/19 |
| 3,940,960 | 3/1976 | Tanifuji et al. | 72/19 |
| 4,087,859 | 5/1978 | Aube | 72/84 |

*Primary Examiner*—Milton S. Mehr
*Attorney, Agent, or Firm*—Craig & Antonelli

[57] ABSTRACT

The rolling force, rolling torque, incoming workpiece thickness and roll gap at a first rolling stand are detected when a workpiece is fed into the nip between the rolls of the first rolling stand to provide their reference values $P_{10}$, $G_{10}$, $H_{10}$ and $S_{10}$ which are stored in a memory, and the reference torque arm $l_{10}$ is computed on the basis of the reference values $G_{10}$ and $P_{10}$ of rolling torque and rolling force. The rolling force, rolling torque, incoming workpiece thickness and roll gap at a second rolling stand are detected when the workpiece is fed into the nip between the rolls of the second rolling stand to provide their reference values $P_{20}$, $G_{20}$, $H_{20}$ and $S_{20}$ which are stored in a memory, and the reference torque arm $l_{20}$ for the second rolling stand is computed on the basis of the reference values $G_{20}$ and $P_{20}$ of rolling torque and rolling force. The torque arms $l_1$ and $l_2$ for the first and second rolling stands are then computed on the basis of the reference torque arms $l_{10}$, $l_{20}$; detected rolling forces $P_1$, $P_2$; detected roll gaps $S_1$, $S_2$; detected incoming workpiece thicknesses $H_1$, $H_2$; and variations $\Delta P_1$, $\Delta P_2$, $\Delta S_1$, $\Delta S_2$, $\Delta H_1$ and $\Delta H_2$ of the reference values. The interstand tension is computed on the basis of the computed torque arms $l_1$, $l_2$, and detected rolling torques $G_1$, $G_2$ and rolling forces $P_1$, $P_2$, and the roll drive main motor is regulated to compensate the deviation of the computed interstand tension from the desired value to maintain the interstand tension constant throughout the rolling operation.

30 Claims, 6 Drawing Figures

INTERSTAND TENSION CONTROL METHOD AND APPARATUS FOR TANDEM ROLLING MILL

BACKGROUND OF THE INVENTION

1. Field of the Invention

This invention relates to a method and apparatus for controlling the interstand tension imparted to a workpiece being rolled by rolling stands of a tandem rolling mill.

2. Description of the Prior Art

In tandem rolling mills, various rolling conditions must be maintained constant throughout the rolling operation in order that a workpiece can be rolled into a product having a uniform thickness, width and shape between the leading and trailing end portions thereof.

It is the variation in the interstand tension which exerts a serious adverse effect on the thickness, width and shape of the product, and it is therefore essential for the purpose of stable rolling to control this interstand tension to be constant throughout the rolling operation.

In a hot rolling mill in which a workpiece is heated up to a high temperature to facilitate plastic working, a slight variation in the interstand tension exerts a great adverse effect on the dimensions and quality of the rolled product. Further, this variation in the interstand tension gives rise to troubles including severing of the workpiece being rolled.

In order to ensure the stable rolling operation, therefore, the rolling equipment is required to include suitable interstand tension control means. For example, in a hot finishing rolling mill for applying finishing rolling to a workpiece, a mechanical interstand tension control means called a looper is provided. The manner of interstand tension control using this looper will be described below by way of example. When the leading end portion of a workpiece is fed into the nip between the rolls of an (i+1)th rolling stand after passing through an i-th rolling stand of the rolling mill, the looper disposed between these rolling stands is set up to form a loop of the workpiece and maintains the loop until the end of the rolling operation so as to prevent impartation of an excessively high tension to the workpiece. However, the prior art system employing such a looper involves the problem that an excessively large interstand tension is imparted to the workpiece at the time of the initial setting up of the looper resulting in a reduction in the precision of the thickness of the workpiece being rolled. Further, in this prior art system, various kinds of disturbance encountered during rolling, for example, the presence of thermal rundown and skid marks in the longitudinal direction of the workpiece tend to give rise to instable rolling operation resulting in impartation of an excessively large tension or damage to the workpiece. Further, it is difficult to ensure the required performance of the looper since the looper is placed in an environment in which a very high temperature and much moisture prevails. Furthermore, such a system is only applicable to hot rolling of a workpiece into a strip and is not applicable to rolling of a workpiece into an angle bar, a round bar or the like.

In an effort to solve such problems, a method has been proposed in which the interstand tension is controlled by detecting it electrically without any mechanical contact with a workpiece. For example, U.S. Pat. No. 3,940,960 granted on U.S. Pat. application Ser. No. 541,953 filed January 17, 1975 and issued Mar. 2, 1976 discloses an interstand tension control based on the ratio between the rolling torque and the rolling force. The operation of the apparatus disclosed in the U.S. patent will be briefly described. The rolling force $P_{10}$ and rolling torque $G_{10}$ at a first rolling stand are detected after a workpiece is fed into the nip between the rolls of the first rolling stand but before the workpiece is fed into the nip between the rolls of a next adjacent second rolling stand, and the ratio $G_{10}/P_{10}$ therebetween is stored in a memory. This ratio $G_{10}/P_{10}$ represents the torque arm for the first rolling stand in the state in which the workpiece at the outlet of the first rolling stand is tension-free. Then, the rolling forces $P_{1B}$, $P_{2B}$ and rolling torques $G_{1B}$, $G_{2B}$ at the first and second rolling stands, immediately after the workpiece is fed into the nip between the rolls of the second rolling stand, are detected, and the torque arm $G_{20}/P_{20}$ for the second rolling stand in a tension-free state is computed on the basis of these detected values. Then, the rolling speed of the first or second rolling stand is controlled so that $(G_{10}/P_{10}) - (G_1/P_1)$ representing the difference between the torque arm value $G_1/P_1$ detected at the first rolling stand during the rolling operation and the torque arm value $G_{10}/P_{10}$ stored in the memory, hence, the torque arm variation becomes equal to $(G_{20}/P_{20}) - (G_2/P_2)$ representing the difference between the torque arm value $G_2/P_2$ detected at the second rolling stand during the rolling operation and the torque arm value $G_{20}/P_{20}$ stored in the memory, whereby the interstand tension imparted to the workpiece can be controlled to be constant throughout the rolling operation.

Such a manner of electrical tension control is adopted in angle bar or round bar rolling mills and rough hot rolling mills and contributes greatly to the realization of the desired stable rolling operation. In these rolling mills, automatic adjustment of the roll gap for the control of the dimensions of products is not carried out in many cases. On the other hand, in a hot finishing rolling mill, the roll gap is positively adjusted or varied so as to control the workpeice thickness with high precision. It has been found that the interstand tension tends to vary in the hot finishing rolling mill when the aforementioned method, in which the variation of the torque arm value at the first rolling stand is controlled to be equal to that of the torque arm value at the second rolling stand, is applied directly for the interstand tension control in the hot finishing rolling mill. Therefore, this technique is not suitable for direct application to the hot rolling mill in which the roll gap must be positively varied. Especially, in the hot finishing rolling mill, such a slight variation in the interstand tension exerts a considerably serious adverse effect on the product since the thickness of the workpiece is quite small.

SUMMARY OF THE INVENTION

It is an object of the present invention to provide, in a tandem rolling mill, an interstand tension control method and apparatus which can control the interstand tension with high precision.

Another object of the present invention is to provide an interstand tension control method and apparatus suitable for application to rolling of a workpiece by a hot finishing, tandem rolling mill.

Still another object of the present invention is to provide an interstand tension control method and apparatus which can detect the interstand tension without any contact with a workpiece and yet control the interstand tension with high precision.

Yet another object of the present invention is to provide an interstand tension control method and apparatus of simple construction which can control interstand tension with high precision.

Other objects of the present invention will become apparent from the following detailed description of preferred embodiments thereof taken in conjunction with the accompanying drawings.

According to the present invention which is applied to a hot rolling mill in which the roll gap is positively varied, an expression of relation among the rolling force, rolling torque and torque arm is utilized to compute the interstand tension, and the interstand tension regulator is controlled so that the deviation of the interstand tension from its desired value can be reduced to zero. More precisely, the torque arm value included in this expression of relation is computed directly on the basis of the detected values of two parameters among incessantly varying parameters which are the incoming and outgoing workpiece thicknesses, roll gap and rolling force at a rolling stand. The computed torque arm value, the detected rolling force and the detected rolling torque are used to compute the interstand tension, and the interstand tension regulator is controlled so that the deviation of the interstand tension from its desired value can be reduced to zero. In another aspect of the present invention, the torque arm value is computed as the sum of the value detected in a tension-free state and the subsequent variation. The torque arm value thus computed, the detected rolling force and the detected rolling torque are used to compute the interstand tension, and the interstand tension regulator is controlled so that the deviation of the interstand tension from its desired value can be reduced to zero. The torque arm variation is computed on the basis of the detected values of variations of two parameters among those which are the incoming and outgoing workpiece thicknesses, the roll gap and the rolling force.

Other features of the present invention will become apparent from the following detailed description of preferred embodiments.

DESCRIPTION OF THE PREFERRED EMBODIMENTS

The present invention will now be described in detail with reference to the drawings.

The basic principle of the present invention will be described before describing the preferred embodiments of the present invention in detail. This description refers to an application of the present invention to a tandem rolling mill consisting of two rolling stands, by way of example. It is to be understood, however, that the application of the present invention is in no way limited to such a tandem rolling mill consisting of two rolling stands, and the present invention is equally effectively applicable to tandem rolling mills consisting of three and more rolling stands.

Figure 1:
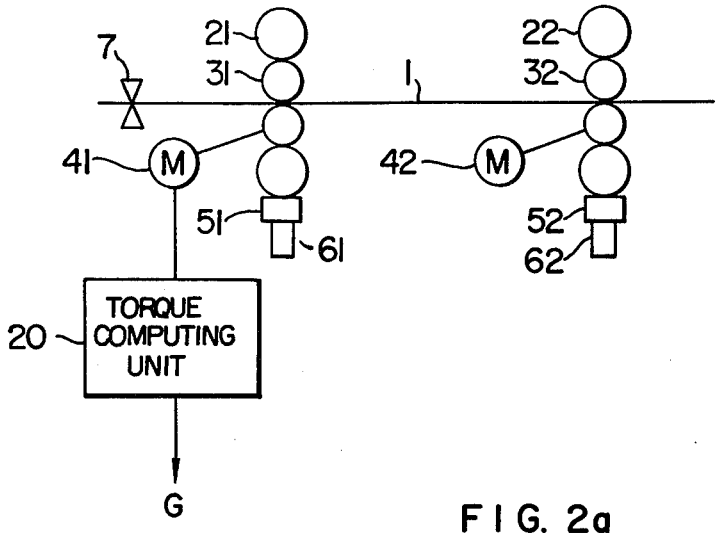
FIG. 1 is a schematic diagram illustrating the basic principle of the present invention and shows the manner of rolling a workpiece by a tandem rolling mill consisting of two rolling stands.

Referring to FIG. 1, a workpiece 1 is being rolled by work rolls 31 and 32 of a first and a second rolling stand respectively, and these work rolls 31 and 32 are backed up by backup rolls 21 and 22 respectively. Main motors 41 and 42 drive the work rolls 31 and 32 respectively, and rolling force detectors 51 and 52, for example, load cells detect the rolling forces at the first and second rolling stands respectively. Roll gap detectors 61 and 62 detect the roll gaps of the first and second rolling stands respectively. A workpiece thickness detector 7 of, for example, the X-ray type detects the workpiece thickness at the inlet of the first rolling stand. A rolling torque computing unit 20 computes the rolling torque at the first rolling stand according to a numerical expression described later. The elements, except the unit 20, shown in FIG. 1 are conventional parts of a tandem rolling mill and are not especially provided for the present invention.

As is commonly known, the theory of rolling teaches that the rolling torques $G_1$ and $G_2$ at the first and second rolling stands are expressed respectively as follows:

$$\begin{cases} G_1 = 2l_1P_1 - R_1T & (1) \\ G_2 = 2l_2P_2 + R_2T & (2) \end{cases}$$

where $l_1$, $l_2$: torque arm $R_1$, $R_2$: roll radius $P_1$, $P_2$: rolling force T: — interstand tension The suffixes 1 and 2 are added to the characters to represent those of the first and second rolling stands respectively. The value of the rolling torque $G_1$ in the equation (1), for example, is computed in the rolling torque computing unit 20 according to the well known formula as follows:

$$G_1 = \frac{V_1 \cdot I_1}{\omega_1} - J_1\frac{d\omega_1}{dt} - G_{LOSS}(\omega_1) \quad (3)$$

where $I_1$: main circuit current of motor $V_1$: terminal voltage of motor $\omega_1$: angular velocity of motor t: time $J_1$: moment of inertia $G_{LOSS}(\omega_1)$: loss torque of motor rotation (This is a function of the motor angular velocity and is previously measured.) In the equation (3), the first and second terms in the right-hand member represent the motor torque and motor acceleration torque respectively. The rolling forces $P_1$ and $P_2$ in the equations (1) and (2) can be detected by the respective load cells 51 and 52.

The equations (1) and (2) can be utilized to express the interstand tension T in various forms. In one form, the interstand tension T is expressed as follows utilizing the equations (1) and (2):

$$T = \frac{2(l_1 - l_2) - (\frac{G_1}{P_1} - \frac{G_2}{P_2})}{\frac{R_1}{P_1} + \frac{R_2}{P_2}} \quad (4)$$

In another form, the interstand tension T is expressed as follows utilizing the equation (1):

$$T = \frac{2l_1P_1 - G_1}{R} \quad (5)$$

The rolling torque $G_1$ and rolling force $P_1$ in the equations (4) and (5) can be computed or directly detected, and therefore, the interstand tension T can be computed from the equation (4) or (5) when the values of the torque arms $l_1$ and $l_2$ are known.

In U.S. Pat. No. 3,940,960 cited hereinbefore as a prior art example, the approximate expression (4) is used for the control of the interstand tension. In other words, in this U.S. Pat. No. 3,940,960, the torque arm difference ($l_{10} - l_{20}$) in the tension-free state (that is, when the workpiece is fed tension-free into the nip between the rolls of the first and second rolling stands) and the subsequent torque arm difference ($l_1 - l_2$) are assumed to be substantially equal to each other. That is, it is assumed that $(l_{10} - l_{20}) - (l_1 - l_2) \approx 0$, and the effect of the torque arms on the interstand tension is neglected in finding the deviation of the interstand tension from its desired value. Thus, in the case of a hot rolling mill in which the roll gap is positively varied during the rolling operation, the computed value of interstand tension will include a detection error giving use to an undesirable reduction in the precision of interstand tension control.

It is known that this torque arm $l_1$ is expressed as follows:

$$l_1 = \lambda\sqrt{R_i(H_i - h_i + \frac{c}{b}P_i)} \quad (6)$$

where

λ: torque arm coefficient ($\lambda \approx 0.4$)

$H_i$: workpiece thickness at inlet of i-th rolling stand $h_i$: workpiece thickness at outlet of i-th rolling stand c: Hitchcock constant (0.000214)

b: mean workpiece width

This torque arm $l_1$ is also expressed as follows by substituting $P_i$ in the gauge meter equation $h_i = S_i + P_i/K_i$ for $P_i$ in the equation (6):

$$l_1 = \lambda\sqrt{R_i\{H_i + (\frac{c}{b}K_i - 1)h_i - \frac{c}{b}Si\}} \quad (7)$$

It can be understood therefore that the value of the torque arm $l_i$ varies also when the workpiece thickness $H_i$ or $h_i$ at the inlet or outlet of the i-th rolling stand varies or when the roll gap $S_i$ of the i-th rolling stand is varied by the automatic workpiece thickness control. It will be seen from the equation (7) that the value of the torque arm $l_i$ can be computed on the basis of the detected values of $H_i$, $h_i$ and $S_i$. The value of $S_i$ can be detected by the roll gap detector 61. When the workpiece thickness $h_i$ at the outlet of the i-th rolling stand is expressed by the gauge meter equation $h_i = S_i + P_i/K_i$ above described, the torque arm $l_i$ is also expressed as follows:

$$l_i = \sqrt{R_i\{H_i - S_i + (-\frac{1}{K_i} + \frac{c}{b})P_i\}} \quad (8)$$

The workpiece thickness $H_1$ at the inlet of the first rolling stand can be detected by the workpiece thickness detector 7, while the workpiece thickness $H_2$ at the inlet of the second rolling stand is given by the value which is obtained by computing the workpiece thickness $h_i$ at the outlet of the first rolling stand according to the gauge meter equation $h_i = S_i + P_i/K_i$ and applying to the variables those values measured when the workpiece portion now going into the second rolling stand has just passed the roll gap of the first rolling stand.

The torque arm $l_i$ can thus be directly computed from one of the equations (6) to (8). Therefore, the value of $l_i$ obtained in this manner may be applied to the equations (4) and (5). However, the values of $H_i$, $h_i$, $S_i$ and $P_i$ include various errors. For instance, the detected value of the roll gap $S_i$ will include a detection error when the zero point of the screw-down position varies due to the factors including the roll wear and heat crown. Inclusion of such an error in the detected value of the roll gap $S_i$ will lead to inclusion of errors in $H_i$ and $h_i$ computed according to the gauge meter equation. Further, drift errors of the detectors may also be included.

Description will now be directed to a method of computing the torque arm including greatly reduced errors.

The torque arm $l_i$ for the i-th rolling stand can be expressed as follows:

$$l_i = l_{i0} + \alpha i_i \quad (9)$$

where $l_{i0}$ represents the reference value of the torque arm described below, and $\Delta l_i$ represents the torque arm variation after the computation of $l_{i0}$. The reference torque arm value $l_{i0}$ for the first rolling stand is computed before the rolling operation on the workpiece starts at the second rolling stand. For example, the reference torque arm value $l_{i0}$ is obtained by introducing $T = 0$ in the equation (1) since no interstand tension is imparted to the workpiece yet immediately before the rolling operation of the workpiece starts at the second rolling stand. Thus, the reference torque arm value $l_{10}$ for the first rolling stand is given by $$2l_{10} = G_{10}/P_{10} \quad (10)$$

The suffix 0 is added to each of the rolling torque $G_1$ and rolling force $P_1$ to indicate that the data detected in the tension-free state are used for the computation of the reference torque arm value $l_{10}$. From the equations (1) and (2), the torque arm $l_2$ for the second rolling stand is expressed as follows:

$$2l_2 = \frac{G_2}{P_2} - \frac{R_1}{R_2}\cdot\frac{P_2}{P_1}(2l_1 - \frac{G_1}{P_1}) \quad (11)$$

The torque arm value $l_2$ obtained immediately after the workpiece is fed into the nip between the rolls of the second rolling stand is employed as the reference torque arm value $l_{20}$ for the second rolling stand. The suffix B added to $G_1$, $G_2$ and $P_1$, $P_2$ to represent the values of the rolling torques and rolling forces detected immediately after the workpiece is fed into the nip between the rolls of the second rolling stand. Then, the following equation holds:

$$2l_{20} = \frac{G_{2B}}{P_{2B}} - \frac{R_1}{R_2} \cdot \frac{P_{2B}}{P_{1B}} (2l_{1B} - \frac{G_{1B}}{P_{1B}}) \quad (12)$$

The torque arm value $l_{1B}$ for the first rolling stand immediately after the workpiece is fed into the nip between the rolls of the second rolling stand is considered to be equal to the value of $l_{10}$ obtained by the equation (10). That is, the reference torque arm value $l_{10}$ is computed on the basis of the values of the rolling torque and rolling force detected after the workpiece is fed into the nip between the rolls of the first rolling stand, and it may be considered that the length of time required for the workpiece to travel between the first and second rolling stands is too short to cause any variation in the torque arm $l_{1B}$. Thus, the equation (12) can be rewritten as follows:

$$2l_{20} = \frac{G_{2B}}{P_{2B}} - \frac{R_1}{R_2} \cdot \frac{P_{2B}}{P_{1B}} (\frac{G_{10}}{P_{10}} - \frac{G_{1B}}{P_{1B}}) \quad (13)$$

The values of $l_{10}$ and $l_{20}$ can therefore be computed from the equations (10) and (13).

The torque arm variation $\Delta l_i$ is computed in a manner as described below. When the values of H, h and S vary by ΔH, Δh and ΔS respectively, the torque arm variation Δl can be expressed by the following equation (6):

$$\Delta l = \frac{\delta l}{\delta H} \Delta H + \frac{\delta l}{\delta h} \Delta h + \frac{\delta l}{\delta S} \Delta S = \frac{\lambda^2_R}{2l_O} \{\Delta H + (\frac{c}{b} K - 1)\Delta h - \frac{c}{b} K \Delta S\} \quad (14)$$

In terms of variations, the gauge meter equation is expressed as $\Delta h = \Delta S + \Delta P/K$. Thus, the following equations hold when the above equation $\Delta h = \Delta S + P/K$ is applied to the equation (14):

$$\Delta l = \frac{\lambda^2 R}{2l_O} \{\Delta H + (\frac{c}{b} - \frac{1}{K})\Delta P - \Delta S\} \quad (14')$$

$$\Delta l = \frac{\lambda^2 R}{2l_O} \{\Delta H + \frac{c}{b} \Delta P - \Delta h\} \quad (14'')$$

Since ΔH, Δh, ΔS and ΔP represent the variations, all the measurement or detection errors are now cancelled. Therefore, Δl is not substantially adversely affected by the detection errors. It will therefore be apparent that the torque arm value $l_i$ given by the equation (9) can be computed with high precision by finding its variation $\Delta l_i$.

The above description will now be summarized. The torque arm value l for each rolling stand rolling a workpiece can be computed as the sum of the reference torque arm value for the rolling stand and the torque arm variation computed on the basis of the detected values of the workpiece thicknesses at the inlet and outlet of the rolling stand and the roll gap and rolling force of the rolling stand. Noting the above fact, the present invention comprises computing the interstand tension on the basis of the torque arm value computed for each rolling stand and the detected values of the rolling torque and rolling force at each rolling stand at that time, and controlling the interstand tension regulating means such as the motor speed control means or screw-down position regulating means so as to establish the equality between the computed interstand tension and the desired interstand tension.

An embodiment of the present invention based upon such a basic principle will be described with reference to FIGS. *2a* and *2b* which show an application of the present invention to a tandem rolling mill consisting of two rolling stands. In FIGS. *2a* and *2b*, the same reference numerals are used to denote the same parts appearing in FIG. 1.

Referring to FIG. *2a*, a motor speed control unit 81 provides an output which changes the speed of the motor 41. Actually, this motor speed control unit 81 includes an automatic speed control system (ASR), an automatic current control system (ACR) responsive to the output of the ASR, a thyristor type power supply driving the motor, and an automatic pulse phase shifter controlling the firing angle of the thyristor in response to the output of the ACR. Rolling torque detectors 20*a* and 20*b* detect the rolling torques G at the first and second rolling stands respectively. A dead time until 11 acts to delay the output signal of the workpiece thickness detector 7 by the length of time required for the workpiece 1 to travel between the detector 7 and the first rolling stand. A workpiece thickness computing unit 100 computes the workpiece thickness at the outlet of the first rolling stand according to the gauge meter equation. Another dead time unit 11' acts to delay the output signal of the computing unit 100 by the length of time required for the workpiece 1 to travel between the first and second rolling stands. The output of the dead time unit 11' provides the workpiece thickness at the inlet of the second rolling stand since the output of the computing unit 100 is delayed by the length of time required for the workpiece 1 to travel between the first and second rolling stands. A computer 1000 provides an interstand tension control compensating signal $\Delta\omega_{Pl}$ as a result of internal computation.

FIG. *2b* is a view similar to FIG. *2a*, but showing in further detail the internal circuits of the computer 1000. Referring to FIG. *2b*, torque arm computing units 30*a* and 30*b* compute the torque arms for the first and second rolling stands respectively. An interstand tension computing unit 9 computes the interstand tension. A control compensating signal computing unit 10 makes necessary computation to provide a control compensating signal output $\Delta\omega_{Pl}$ representing the deviation of the computed interstand tension from the desired value.

The torque arm computing unit 30*a* associated with the first rolling stand computes the reference torque arm value $l_{10}$ according to the equation (10) after the workpiece 1 is fed into the nip between the rolls of the first rolling stand but before the workpiece 1 is fed into the nip between the rolls of the second rolling stand. At the same time, the output $H_1$ representing the workpiece thickness at the inlet of the first rolling stand, which is detected by the workpiece thickness detector 7 and then delayed by the dead time unit 11 by the workpiece traveling time, the output $S_1$ of the roll gap detector 61 and the output $P_1$ of the load cell 51 are applied to the computing unit 30*a* to be stored therein as reference values $H_{10}$, $S_{10}$ and $P_{10}$ together with $l_{10}$. Similarly, the torque arm computing unit 30*b* associated with the second rolling stand computes the reference torque arm value $l_{20}$ according to the equation (13) immediately after the workpiece 1 is fed into the nip between the rolls of the second rolling stand. At the same time, the output $H_2$ of the dead time unit 11', the output $S_2$ of the roll gap detector 62 and the output $P_2$ of the load cell 52 are applied to the computing unit 30b to be stored as reference values $H_{20}$, $S_{20}$ and $P_{20}$ together with $l_{20}$. The feed of the workpiece 1 into the nip between the rolls of each rolling stand and the departure of the trailing end portion of the workpiece 1 from each rolling stand are detected by means (not shown) responding to an abrupt change in the output of the associated load cell. After computing and storing the reference torque arm values $l_{10}$ and $l_{20}$, the torque arm computing units 30a and 30b continue to compute the torque arms $l_i$ on the basis of the stored values of $l_{10}$ *and* $l_{20}$ until the rolling operation by the rolling mill is completed. That is, the following deviations are computed in response to the application of the detected values of the workpiece thickness $H_i$, roll gap $S_i$ and rolling force $P_i$:

$$\Delta H_i = H_i - H_{i0} \quad (15)$$

$$\Delta S_i = S_i - S_{i0} \quad (16)$$

$$\Delta P_i = P_i - P_{i0} \quad (17)$$

In this case, i = 1 or i = 2 since the tandem rolling mill consists of the two rolling stands. In the computing units 30a and 30b, these values $\Delta H_i$, $\Delta S_i$ and $\Delta P_i$ are introduced into the equation (14') for determining the value of $\Delta l_i$. Then, in each of the computing units 30a and 30b, the value of $\Delta l_i$ thus determined and the stored reference torque arm value $l_{i0}$ are introduced in the equation (9) to compute the torque arm value $l_i$ during the rolling operation on the workpiece 1.

The outputs of the rolling torque detectors 20a and 20b representing the rolling torques $G_1$ and $G_2$, the outputs of the rolling force detectors or load cells 51 and 52 representing the rolling forces $P_1$ and $P_2$, and the outputs of the torque arm computing units 30a and 30b representing the torque arms $l_1$ and $l_2$ for the first and second rolling stands respectively are applied to the interstand tension computing unit 9 which determines the interstand tension T by introducing these values in the equation (4) together with the work roll radius settings $R_1$ and $R_2$. The interstand tension $\tilde{t}$ per unit area is given by the following equation:

$$\tilde{t} = T/h_1 \cdot b \quad (18)$$

where b is the setting of the mean workpiece width, and $h_1$ is the workpiece thickness at the outlet of the first rolling stand and represents the value computed according to the equation $h_1 = S_1 + P_1/K_1$. Of course, the directly detected value of $h_1$ may be used.

The deviation of the output $\tilde{t}$ of the interstand tension computing unit 9 from the desired unit value $t_0$ is then computed to the applied to the control compensating signal computing unit 10. In the control compensating signal computing unit 10, the deviation of the computed unit interstand tension $\tilde{t}$ from the desired unit value $t_0$ is subjected to, for example, proportional plus integral compensation to determined the signal value $\Delta\omega_P$ to be applied to the motor speed control unit 81 for correcting the speed of the motor 41. Practically, the control compensating signal value $\Delta\omega_P$ is computed according to, for example, the following equation:

$$\Delta\omega_P = L\{K_H(1 + \frac{1}{T_H P_L})L^{-1}(t - t_P)\} \quad (19)$$

where L is the symbol of Laplace transformation, $K_H$ is a proportional gain, $T_H$ is an integration time constant, and $P_L$ is a Laplace variable. This control compensating signal $\Delta\omega_P$ is added to the control signal $\omega_{P1}$ applied to the motor speed control unit 81 for regulating or correcting the speed of the motor 41, so that the interstand tension can be controlled with high precision. Elimination of the looper for the interstand tension control can save the labor which has been required for the maintenance of the looper.

Figure 2A:
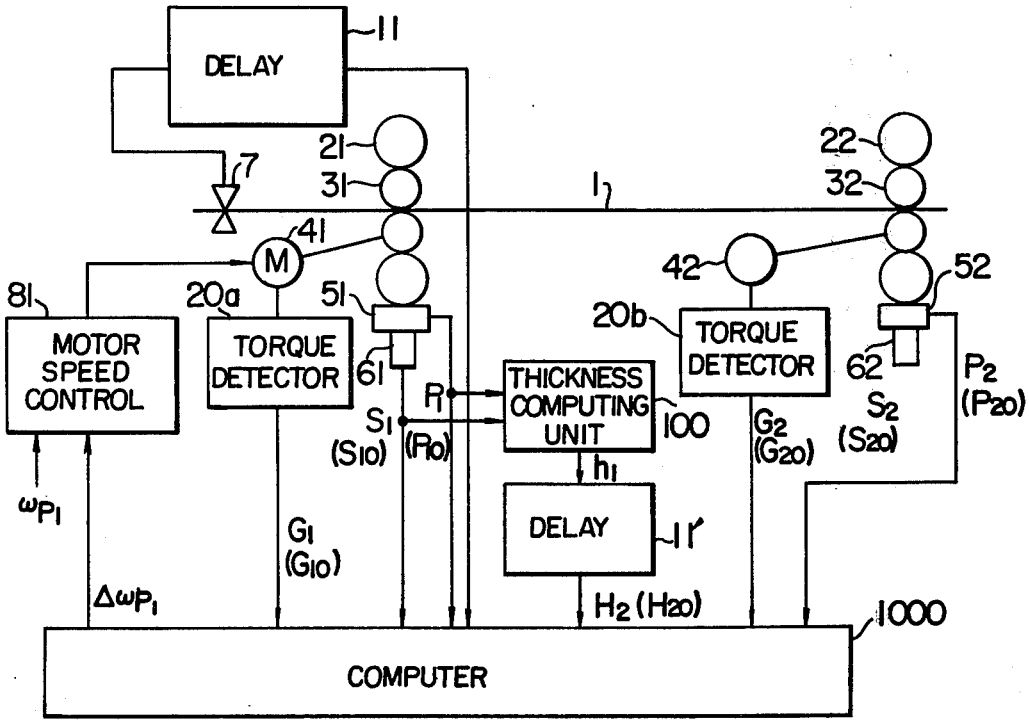
FIGS. 2*a* and 2*b* are block diagrams of an embodiment of the present invention when applied to a tandem rolling mill consisting of two rolling stands.
Figure 2B:
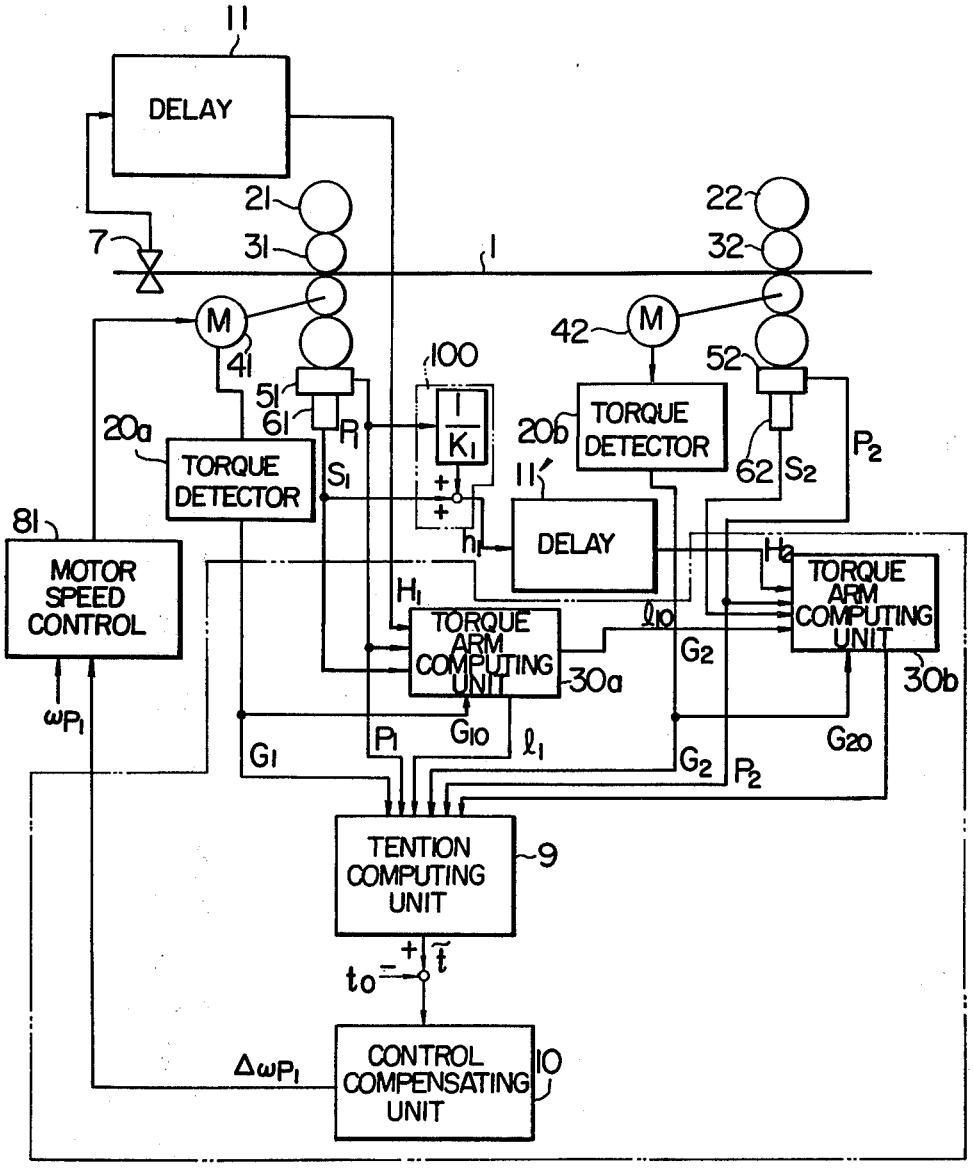
Figure 2C:
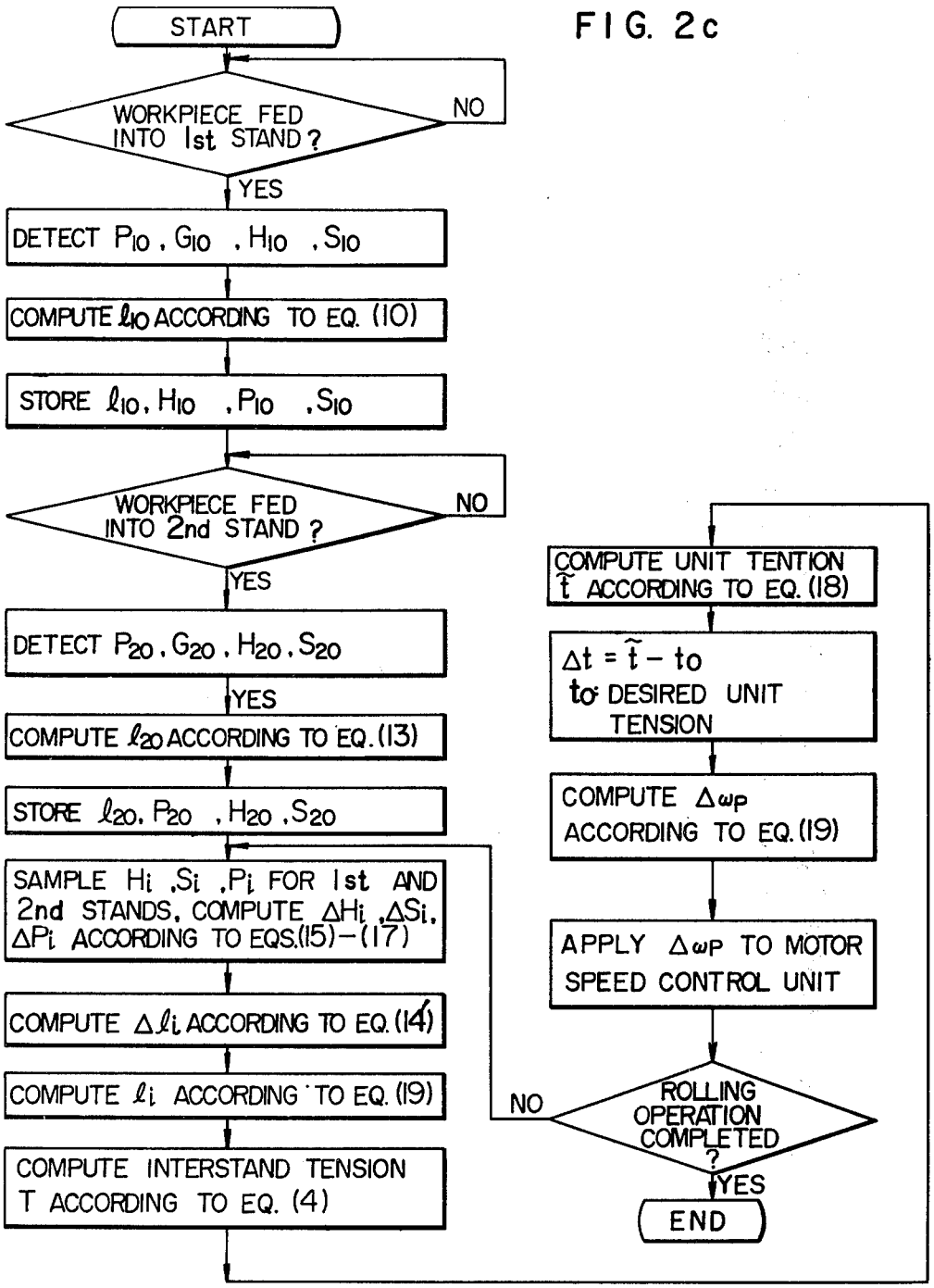
FIG. 2*c* is a flow chart of the operation of the embodiment shown in FIGS. 2*a* and 2*b*.

FIG. 2c is a flow chart of the operation of the system shown in FIG. 2b. Description of this flow chart will not be given herein as the steps shown in FIG. 2c are substantially the same as those described already with reference to FIG. 2b.

Figure 3A:
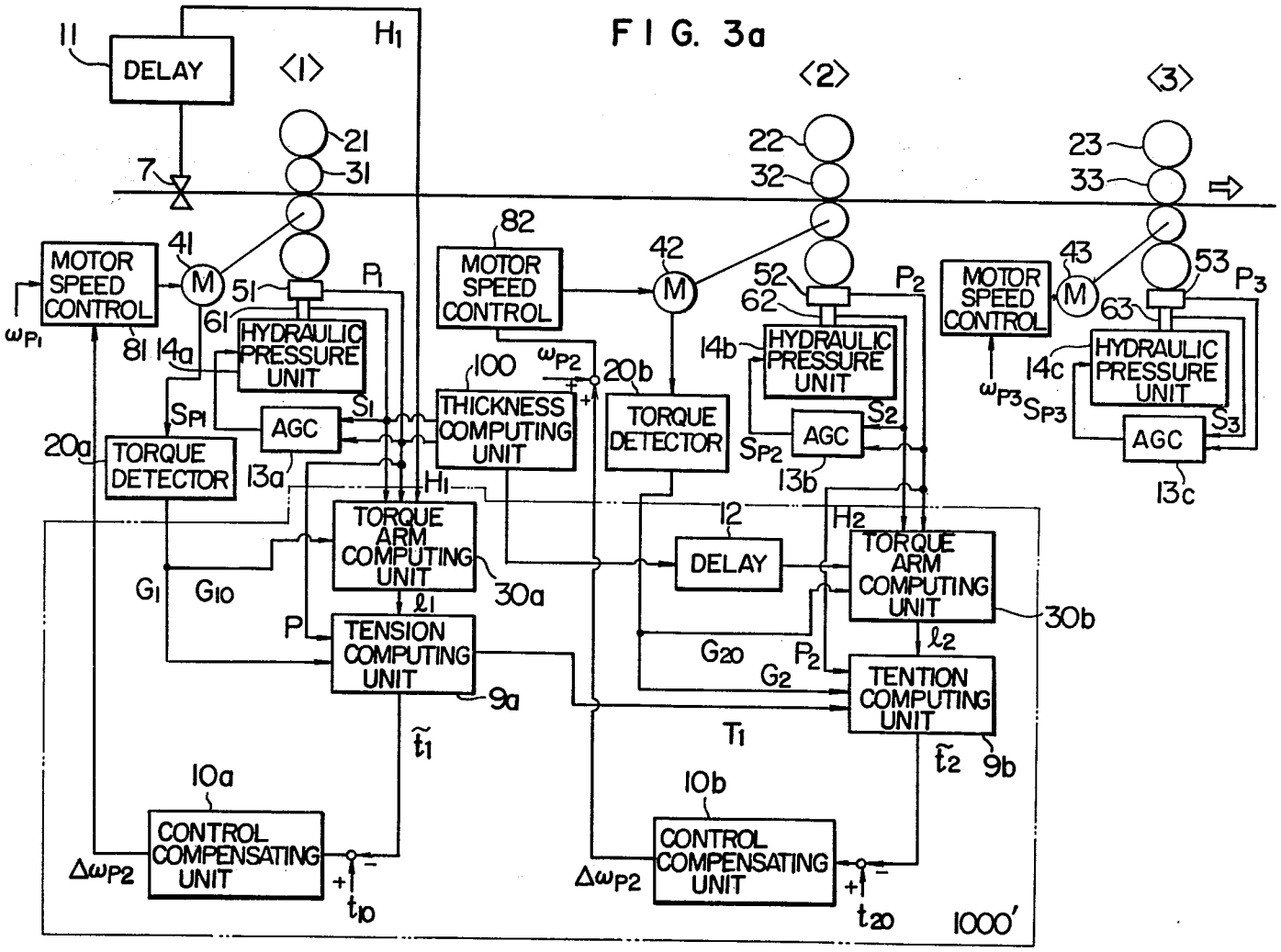
FIG. 3*a* is a block diagram of another embodiment of the present invention when applied to a tandem rolling mill consisting of three rolling stands.

FIG. 3a is a block diagram of another embodiment of the present invention in which the interstand tension is controlled on the basis of the result of computation according to the tension computing equation (5). In FIG. 3a, the present invention is applied to a tandem rolling mill consisting of three rolling stands, and the same reference numerals are used to denote the same parts and symbols appearing in FIGS. 2a and 2b.

Referring to FIG. 3a, the third rolling stand includes backup rolls 23, work rolls 33, a main motor 43, a load cell 53 and a roll gap detector 63. Screw-down units or (hydraulic pressure units) 14a to 14c are provided for setting the roll gaps of the first, second and third rolling stands respectively. A dead time unit 12 acts to delay the signal representing the workpiece thickness $h_1$ at the outlet of the first rolling stand by the length of time required for the workpiece 1 to travel between the first and second rolling stands thereby providing the signal representing the workpiece thickness $H_2$ at the inlet of the second rolling stand. Automatic gauge control units (AGC) 13a to 13c are provided for the first, second and third rolling stands respectively. Interstand tension computing units 9a and 9b compute the interstand tension between the first and second rolling stands and that between the second and third rolling stands respectively. Control compensating signal computing units 10a and 10b in a computer 1000' are connected with motor speed control units 81 and 82 for the motors 41 and 42 respectively. Another motor speed control unit 83 controls the speed of the motor 43.

The rolling torque detector 20a detects continuously the rolling torque $G_1$ at the first rolling stand during the rolling operation. In the torque arm computing unit 30a, the output $P_1$ of the rolling force detector or load cell 51 and the output $G_1$ of the rolling torque detector 20a are introduced in the equation (10) to compute the reference torque arm value $l_{10}$ for the first rolling stand before the leading end portion of the workpiece 1 is fed into the nip between the rolls of the second rolling stand by traveling from the first rolling stand. At the same time, the output of the thickness comouting unit 100 representing the workpiece thickness $H_1$ at the inlet of the second rolling stand and delayed by the dead time unit 11 is applied to the torque arm computing unit 30a together with the output $S_1$ of the roll gap detector 61 and the output $P_1$ of the load cell 51 to be stored therein as their reference values $H_{10}$, $S_{10}$ and $P_{10}$ together with $l_{10}$. During the subsequent period of rolling operation at the first rolling stand, the deviations of the output $H_1$ of the dead time unit 11, the output $S_1$ of the roll gap detector 61 and the output $P_1$ of the load cell 51 from the stored reference values $H_{10}$, $S_{10}$ and $P_{10}$ are computed as follows:

$$\Delta H_1 = H_1 - H_{10} \quad (20)$$

$$\Delta S_1 = S_1 - S_{10} \tag{21}$$

$$\Delta P_1 = P_1 - P_{10} \tag{22}$$

These values $\Delta H_1$, $\Delta S_1$ and $\Delta P_1$ are introduced in the equation (14') to find the torque arm deviation $\Delta l_1$. The torque arm $l_1$ is determined as the sum of this deviation $\Delta l_1$ and the reference value $l_1$.

As soon as the workpiece 1 is fed into the nip between the rolls of the second rolling stand, the interstand tension computing unit 9a starts to compute the interstand tension. That is, the interstand tension $T_1$ is computed from the equation (5) using the detected rolling force $P_1$, the output $l_1$ of the torque arm computing unit 30a and the output $G_1$ of the rolling torque detector 20a. On the basis of the computed tension $T_1$, the unit interstand tension $t_1$ is computed as follows:

$$\tilde{t}_1 = (T_1/h_1 \cdot b) \tag{23}$$

where b is the workpiece width setting, and $h_1$ is the workpiece thickness computed according to the gauge meter equation.

The deviation of the output $t_1$ of the tension computing unit 9a from the desired unit value $t_{01}$ is subjected to, for example, proportional plus integral compensation in the control compensating signal computing unit 10a so as to provide a most suitable response of this interstand tension control system. The output $\Delta\omega_{P1}$ of this computing unit 10a is applied to the motor speed control unit 81 to be added to the motor speed instruction signal $\omega_{P1}$. The motor speed is changed depending on the level of this output $\Delta\omega_{P1}$ of the computing unit 10a so that the interstand tension between the first and second rolling stands can be controlled to be set at the desired value. The interstand tension between the second and third rolling stands is also entirely similarly controlled.

Figure 3B:
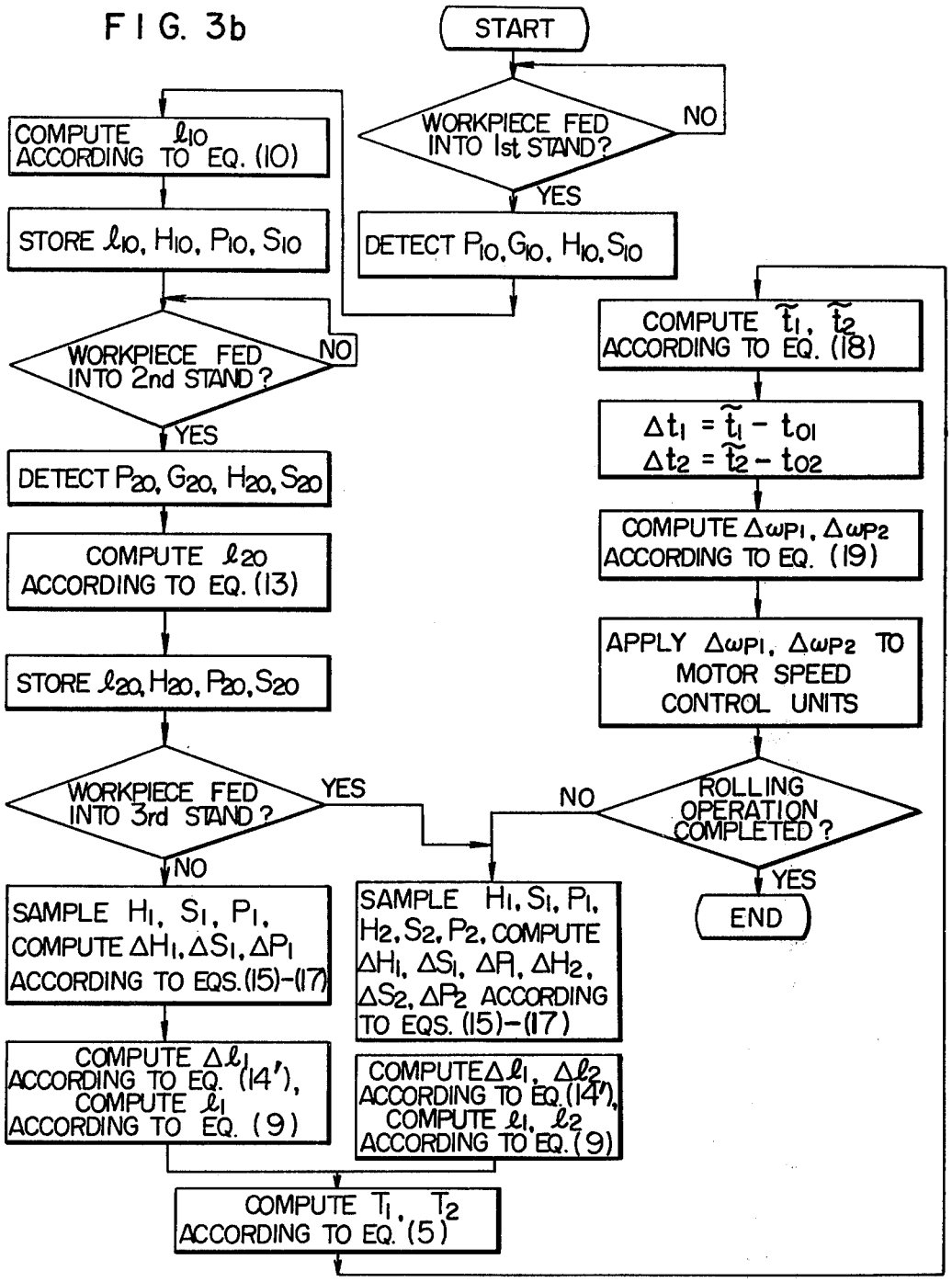
FIG. 3*b* is a flow chart of the operation of the embodiment shown in FIG. 3*a*.

FIG. 3b is a flow chart of the operation of the embodiment shown in FIG. 3a.

An application of the present invention to a tandem rolling mill consisting of N rolling stands will next be described. The following torque equations hold for the N rolling stands:

$$\begin{cases} G_1 = 2l_1P_1 - R_1T_1 \\ G_2 = 2l_2P_2 - R_2(T_2 - T_1) \\ G_3 = 2l_3P_3 - R_3(T_3 - T_2) \\ \vdots \\ G_N = 2l_NP_N + R_NT_{N-1} \end{cases} \tag{24}$$

Transformation of the equations (24) provides the following determinant equation:

$$\begin{pmatrix} a_{11} & a_{12} & & & & \\ a_{21} & a_{22} & a_{23} & & 0 & \\ & a_{32} & a_{33} & a_{34} & & \\ & & \ddots & \ddots & \ddots & \\ & & a_{N-2\,N-3} & a_{N-2\,N-2} & a_{N-2\,N-1} & \\ & 0 & & & & \\ & & & a_{N-1\,N-2} & a_{N-1\,N-1} & \end{pmatrix} \begin{pmatrix} T_1 \\ T_2 \\ T_3 \\ \\ T_{N-2} \\ \\ T_{N-1} \end{pmatrix} = \begin{pmatrix} b_1 \\ b_2 \\ b_3 \\ \\ b_{N-2} \\ \\ b_{N-1} \end{pmatrix} \tag{25}$$

where $$\begin{cases} a_{ii} = \dfrac{R_i}{P_i} + \dfrac{R_{i+1}}{P_{i+1}} & (26) \\ a_{ii+1} = a_{i+1 \cdot i} = -\dfrac{R_{i+1}}{P_{i+1}} & (27) \\ b_i = (l_1 - l_{i+1}) - \dfrac{G_i}{P_i} - \dfrac{G_{i+1}}{P_{i+1}} & (28) \\ i = 1 \sim N - 1 \end{cases}$$

The torque arms in the equation (28) can be computed from the equations including the equations (9) and (14') as in the case of the embodiment shown in FIG. 3a. Since the rolling torques $G_i$, $G_{i+1}$ and the rolling forces $P_i$, $P_{i+1}$ in the equations (26) to (28) can also be computed or detected, it is possible to know the values of all the elements of the matrix and the values of all the vector elements in the left-hand and right-hand members of the equation (25). Therefore, the interstand tensions $T_1, T_2, \ldots T_{N-1}$ can be determined by solving the determinant equation (25). The interstand tension $T_i$ obtained for the i-th and (i+1)th rolling stands is then divided by the sectional area of the workpiece traveling between these two rolling stands to obtain the unit interstand tension $t_i$ so that the deviation of the computed value $t_i$ from the desired unit interstand tension $t_{10}$ can be determined. The signal representing this deviation is amplified to correct the speed of the motor in the i-th or (i+1)th rolling stand. Thus, the interstand tensions in a tandem rolling mill consisting of N rolling stands can be controlled with high precision without the use of loopers.

Another method of determining the torque arm variation $\Delta l$ will next be described. The variation of the gauge meter equation $h = S + P/K$ provides the following equation:

$$\Delta h = \Delta S + \Delta P/K \tag{29}$$

Then, the following equation holds when ΔS is eliminated from the equation (29) using the equation (14):

$$\Delta l = \frac{\lambda^2 R}{2l_O}\{\Delta H + \frac{c}{b}\Delta P - \Delta h)\} \quad (30)$$

when the workpiece thickness variation Δh at the outlet of a rolling stand can be reduced to zero by the effect of the automatic gauge control (AGC), the following equation holds:

$$\Delta l = \frac{\lambda^2 R}{2l_O}(\Delta H + \frac{c}{b}\Delta P) \quad (31)$$

In this case, the torque arm variation Δl can be computed using the workpiece thickness variation ΔH at the rolling stand inlet and the rolling force variation ΔP only.

when the workpiece thickness at the outlet of a preceding rolling stand can be controlled to be substantially constant by the effect of the AGC associated therewith, the workpiece thickness variation ΔH at the inlet of the directly following rolling stand can be regarded to be zero. Therefore, the following equation is obtained when ΔH in the equation (31) is taken as ΔH = 0:

$$\Delta l = \frac{\lambda^2 R}{2l_O}\cdot\frac{c}{b}\Delta P \quad (32)$$

In this case, the torque arm variation Δl can be computed using the rolling force variation ΔP only without using the equations (14) and (14').

Depending on the rolling conditions, the rolling force variation ΔP may be regarded to be quite small compared with the workpiece thickness variations ΔH and Δh. In such a case, the following equation holds:

$$\Delta l = \frac{\lambda^2 R}{2l_O}(\Delta H - \Delta h) \quad (33)$$

$$\approx \frac{\lambda^2 R}{2l_O}(\Delta H - \Delta S) \quad (34)$$

Thus, in this case, the torque arm variation Δl can be computed using ΔH and Δh or ΔH and ΔS.

Any one of the aforementioned various equations can be used for the computation and determination of the torque arm variation Δl, and this value Δl is introduced in the equation (9) so that the desired interstand tension control can be attained. In each of the aforementioned embodiments, the motor speed instruction signal is corrected depending on the deviation of the computed interstand tension from the desired value at a rolling stand. This means that the mass flow of the workpiece at this rolling stand is corrected. In another method of correcting this mass flow, the roll gap is corrected instead of correcting the motor speed. Therefore, the screwdown stroke may be changed depending on the interstand tension deviation in a modification of the present invention so that the interstand tension can be similarly effectively controlled.

It will be understood from the foregoing detailed description of the present invention that the interstand tension can be controlled with high precision without any contact with a workpiece. The present invention is especially effective in controlling the interstand tension with high precision even when the screw-down stroke is changed during the interstand tension control to deal with excessive variations in the thickness of a workpiece being rolled.

What is claimed is:

1. In a tandem rolling mill consisting of a plurality of rolling stands, an interstand tension control method including the step of computing the interstand tension on the basis of the detected rolling force and rolling torque, and the step of computing the deviation of said computed interstand tension from the desired value and applying an interstand tension control compensating signal compensating said deviation to interstand tension regulating means thereby maintaining constant the interstand tension imparted to a workpiece being rolled by said tandem rolling mill, said interstand tension computing step comprising:

the first step of computing the reference torque arm value for an i-th rolling stand and storing the same in a memory after the workpiece is fed into the nip between the rolls of said i-th rolling stand but before the workpiece is fed into the nip between the rolls of an (i+1)th rolling stand;

the second step of computing the torque arm value using said reference torque arm value and more than one of the physical quantities including the workpiece thicknesses at the inlet and outlet of said i-th rolling stand, the roll gap of said i-th rolling stand and the rolling force at said i-th rolling stand; and the third step of computing the interstand tension on the basis of said computed torque arm value and the detected values of the rolling force and rolling torque.

2. An interstand tension control method as claimed in claim 1, wherein, in said step of computing said interstand tension, the total interstand tension is divided by the sectional area of the workpiece to provide the unit interstand tension, and said interstand tension regulating means is controlled to compensate the deviation of said computed unit interstand tension from the desired unit value.

3. In a tandem rolling mill consisting of a plurality of rolling stands, an interstand tension control method including the step of computing the interstand tension on the basis of the detected rolling force and rolling torque, and the step of computing the deviation of said computed interstand tension from the desired value and applying an interstand tension control compensating signal compensating said deviation to interstand tension regulating means thereby maintaining constant the interstand tension imparted to a workpiece being rolled by said tandem rolling mill, said interstand tension computing step comprising:

the first step of detecting the rolling torque and rolling force at an i-th rolling stand after the workpiece is fed into the nip between the rolls of said i-th rolling stand but before the workpiece is fed into the nip between the rolls of an (i+1)th rolling stand and storing the ratio between the detected values of the rolling torque and rolling force in a memory as the reference torque arm value for said i-th rolling stand;

the second step of detecting more than one of the physical quantities including the workpiece thicknesses at the inlet and outlet of said i-th rolling stand, the roll gap of said i-th rolling stand and the rolling force at said i-th rolling stand at the time of said detection in the first step, and storing the detected physical quantities in the memory as their reference values for said i-th rolling stand;

the third step of computing the variations of said reference values for said i-th rolling stand while the workpiece is being rolled by both said i-th and (i+1)th rolling stands, and computing the torque arm variation at that time on the basis of said variations of said reference values; and the fourth step of computing the torque arm value at that time on the basis of said torque arm variation and said reference torque arm value for said i-th stand, and computing the interstand tension on the basis of said computed torque arm value and the detected values of the rolling torque and rolling force detected at said i-th rolling stand at that time.

4. An interstand tension control method as claimed in claim 3, wherein, in said step of computing said interstand tension, the total interstand tension is divided by the sectional area of the workpiece to provide the unit interstand tension, and the interstand tension control compensating signal is computed to compensate the deviation of said computed unit interstand tension from the desired unit value.

5. An interstand tension control method as claimed in claim 3, wherein said torque arm variation $\Delta l_i$ is computed according to the equation $$\Delta l = \frac{\lambda^2 R}{2 l_O} (\Delta H - \Delta h)$$

where

λ: torque arm coefficient

*R:* roll radius $l_O$: reference torque arm

ΔH: workpiece thickness variation at rolling stand inlet

Δ*h:* workpiece thickness variation at rolling stand outlet

6. An interstand tension control method as claimed in claim 3, wherein said torque arm variation $\Delta l_i$ is computed according to the equation $$\Delta l = \frac{\lambda^2 R}{2 l_O} (\Delta H - \Delta S)$$

where

λ: torque arm coefficient

*R:* roll radius $l_O$: reference torque arm

ΔH: workpiece thickness variation at rolling stand inlet

ΔS: roll gap variation

7. An interstand tension control method as claimed in claim 3, wherein said torque arm variation $\Delta l_i$ is computed according to the equation $$\Delta l = \frac{\lambda^2 R}{2 l_O} \cdot \frac{c}{b} \cdot \Delta P$$

where

λ: torque arm coefficient

R: roll radius $l_O$: reference torque arm c: Hitchcock constant b: mean workpiece width ΔP: rolling force variation

8. An interstand tension control method as claimed in claim 3, wherein said torque arm variation $\Delta l_1$ is computed according to the equation $$\Delta l = \frac{\lambda^2 R}{2 l_O} (\Delta H + \frac{c}{b} \cdot \Delta P)$$

where

λ: torque arm coefficient

R: roll radius $l_O$: reference torque arm

ΔH: workpiece thickness variation at rolling stand inlet c: Hitchcock constant b: mean workpiece width ΔP: rolling force variation

9. An interstand tension control method as claimed in claim 3, wherein said torque arm variation $\Delta l_i$ is computed according to the equation $$\Delta l = \frac{\lambda^2 R}{2 l_O} (\Delta H + \frac{c}{b} \cdot \Delta P - \Delta h)$$

where

λ: torque arm coefficient

R: roll radius $l_O$: reference torque arm

ΔH: workpiece thickness variation at rolling stand inlet c: Hitchcock constant b: mean workpiece width ΔP: rolling force variation Δh: workpiece thickness variation at rolling stand outlet

10. An interstand tension control method as claimed in claim 3, wherein said torque arm variation $\Delta l_i$ is computed according to the equation $$\Delta l = \frac{\lambda^2 R}{2 l_O} \{\Delta H + (\frac{c}{b} \cdot K - 1)\Delta h - \frac{c}{b} \cdot K \cdot \Delta S\}$$

where

λ: torque arm coefficient

R: roll radius $l_0$: reference torque arm

ΔH: workpiece thickness variation at rolling stand inlet c: Hitchcock constant b: mean workpiece width K: spring constant of mill Δh: workpiece thickness variation at rolling stand outlet ΔS: roll gap variation

11. An interstand tension control method as claimed in claim 3, wherein said torque arm variation $\Delta l_i$ is computed according to the equation $$\Delta l = \frac{\lambda^2 R}{2 l_O} \{\Delta H + (\frac{c}{b} - \frac{1}{K})\Delta P - \Delta S\}$$

where

λ: torque arm coefficient

R: roll radius $l_O$: reference torque arm

ΔH: workpiece thickness variation at rolling stand inlet
c: Hitchcock constant
b: mean workpiece width
K: spring constant of mill
ΔP: rolling force variation
ΔS: roll gap variation 12. An interstand tension control method as claimed in claim 3, wherein said torque arm variation $\Delta l_i$ is computed according to the equation $$\Delta l = \frac{\lambda^2 R}{2l_O}(\Delta H + \frac{c}{b}\cdot\Delta P - \Delta h)$$

where
λ: torque arm coefficient
R: roll radius
$l_0$: reference torque arm
ΔH: workpiece thickness variation at rolling stand inlet
c: Hitchcock constant
b: mean workpiece width
ΔP: rolling force variation
Δh: workpiece thickness variation at rolling stand outlet 13. An interstand tension control method as claimed in claim 3, wherein the signal representing the workpiece thickness $H_i$ at the inlet of said i-th rolling stand (i >2) is provided by delaying the signal representing the workpiece thickness $h_{i-1}$ at the outlets of an (i−1)th rolling stand by the length of time required for the workpiece to travel between said (i−1)th and i-th rolling stands.

14. An interstand tension control method as claimed in claim 13, wherein said workpiece thickness $h_{i-1}$ at the outlet of said (i−1)th rolling stand is found by introducing the detected values of the rolling force P and roll gap S of said (i−1)th rolling stand in the gauge meter equation $$h = S + P/K$$

where
K: spring constant of mill

15. In a tandem rolling mill consisting of a plurality of rolling stands, an interstand tension control method including the step of computing the interstand tension on the basis of the detected values of the rolling force and rolling torque detected at an i-th rolling stand (where i is an integer less by more than one than the total number of the rolling stands), and the step of computing the deviation of said computed interstand tension from the desired value and applying an interstand tension control compensating signal compensating said deviation to interstand tension regulating means thereby maintaining constant the interstand tension imparted to a workpiece being rolled by said tandem rolling mill, said interstand tension computing step comprising:

the first step of detecting the rolling torque and rolling force at said i-th rolling stand after the workpiece is fed into the nip between the rolls of said i-th rolling stand but before the workpiece is fed into the nip between the rolls of an (i+1)th rolling stand, and storing the ratio between the detected values of the rolling torque and rolling force in a memory as the reference torque arm value for said i-th rolling stand;

the second step of detecting more than one of the physical quantities including the workpiece thicknesses at the inlet and outlet of said i-th rolling stand, the roll gap of said i-th rolling stand and the rolling force at said i-th rolling stand at the time of said detection in the first step, and storing the detected physical quantities in the memory as their reference values for said i-th rolling stand;

the third step of detecting the rolling torque and rolling force at said (i+1)th rolling stand immediately after the workpiece is fed into the nip between the rolls of said (i+1)th rolling stand, and computing the reference torque arm value for said (i+1)th rolling stand on the basis of the detected values of the rolling torque and rolling force to store the same in a memory;

the fourth step of detecting more than one of the physical quantities including the workpiece said at the inlet and outlet of said (i+1)th rolling stand, the roll gap of said (i+1)th rolling stand and the rolling force at said (i+1)th rolling stand at the time of said detection in the third step, and storing the detected physical quantities in the memory as their reference values for said (i+1)th rolling stand;

the fifth step of computing the variations of said reference values for said i-th and (i+1)th rolling stands while the workpiece is being rolled by said i-th and (i+1)th rolling stands; and the sixth step of computing the torque arms at that time on the basis of said reference value variations and said reference torque arm values for said i-th and (i+1)th rolling stands, and computing the interstand tension on the basis of said computed torque arm values and the detected values of the rolling torques and rolling forces detected at said i-th and (i+1)th rolling stands at that time.

16. An interstand tension control method as claimed in claim 15, wherein, in said step of computing said interstand tension, the total interstand tension is divided by the sectional area of the workpiece to provide the unit interstand tension, and the interstand tension control compensating signal is computed to compensate the deviation of said computed unit interstand tension from the desired unit value.

17. An interstand tension control method as claimed in claim 15, wherein the signal representing the workpiece thickness $H_{i+1}$ at the inlet of said (i+1)th rolling stand is provided by delaying the signal representing the workpiece thickness $h_i$ at the outlet of said i-th rolling stand by the length of time required for the workpiece to travel between said i-th and (i+1)th rolling stands.

18. An interstand tension control method as claimed in claim 15, wherein said workpiece thickness $h_i$ at the outlet of said i-th rolling stand is computed on the basis of the detected values of the rolling force and roll gap of said i-th rolling stand.

19. An interstand tension control method as claimed in claim 15, wherein said torque arm variations $\Delta l_i$ and $\Delta l_{i+1}$ at said i-th and (i+1)th rollling stands respectively are computed according to the equation $$\Delta l = \frac{\lambda^2 R}{2l_O}(\Delta H - \Delta h)$$

where
λ: torque arm coefficient
R: roll radius
$l_O$: reference torque arm
ΔH: workpiece thickness variation at rolling stand inlet
Δh: workpiece thickness variation at rolling stand outlet

20. An interstand tension control method as claimed in claim 15, wherein said torque arm variations $\Delta l_i$ and $\Delta l_{i+1}$ at said i-th and (i+1)th rolling stands respectively are computed according to the equation $$\Delta l = \frac{\lambda^2 R}{2 l_O} (\Delta H - \Delta S)$$

where
λ: torque arm coefficient
R: roll radius
$l_0$: reference torque arm
ΔH: workpiece thickness variation at rolling stand inlet
ΔS: roll gap variation

21. An interstand tension control method as claimed in claim 15, wherein said torque arm variations $\Delta l_i$ and $\Delta l_{i+1}$ at said i-th and (i+1)th rolling stands respectively are computed according to the equation $$\Delta l = \frac{\lambda^2 R}{2 l_O} \cdot \frac{c}{b} \cdot \Delta P$$

where
λ: torque arm coefficient
R: roll radius
$l_0$: reference torque arm
c: Hitchcock constant
b: mean workpiece width
ΔP: rolling force variation

22. An interstand tension control method as claimed in claim 15, wherein said torque arm variations $\Delta l_i$ and $\Delta l_{i+1}$ at said i-th and (i+1)th rolling stands respectively are computed according to the equation $$\Delta l = \frac{\lambda^2 R}{2 l_O} (\Delta H + \frac{c}{b} \cdot \Delta P)$$

where
λ: torque arm coefficient
R: roll radius
$l_0$: reference torque arm
ΔH: workpiece thickness variation at rolling stand inlet
c: Hitchcock constant
b: mean workpiece width
ΔP: rolling force variation

23. An interstand tension control method as claimed in claim 15, wherein said torque arm variations $\Delta l_i$ and $\Delta l_{i+1}$ at said i-th and (i+1)th rolling stands respectively are computed according to the equation $$\Delta l = \frac{\lambda^2 R}{2 l_O} (\Delta H + \frac{c}{b} \cdot \Delta P - \Delta h)$$

where
λ: torque arm coefficient
R: roll radius
$l_0$: reference torque arm
ΔH: workpiece thickness variation at rolling stand inlet
c: Hitchcock constant
b: mean workpiece width
ΔP: rolling force variation
Δh: workpiece thickness variation at rolling stand outlet

24. An interstand tension control method as claimed in claim 15, wherein said torque arm variations $\Delta l_i$ and $\Delta l_{i+1}$ at said i-th and (i+1)th rolling stands respectively are computed according to the equation $$\Delta l = \frac{\lambda^2 R}{2 l_O} \{\Delta H + (\frac{c}{b} \cdot K - 1)\Delta h - \frac{c}{b} \cdot K \cdot \Delta S\}$$

where
λ: torque arm coefficient
R: roll radius
$l_0$: reference torque arm
ΔH: workpiece thickness variation at rolling stand inlet
c: Hitchcock constant
b: mean workpiece width
K: spring constant of mill
Δh: workpiece thickness variation at rolling stand outlet
ΔS: roll gap variation

25. An interstand tension control method as claimed in claim 15, wherein said torque arm variations $\Delta l_i$ and $\Delta l_{i+1}$ at said i-th and (i+1)th rolling stands respectively are computed according to the equation $$\Delta l = \frac{\lambda^2 R}{2 l_O} \{\Delta H + (\frac{c}{b} - \frac{1}{K})\Delta P - \Delta S\}$$

where
λ: torque arm coefficient
R: roll radius
$l_0$: reference torque arm
ΔH: workpiece thickness variation at rolling stand inlet
c: Hitchcock constant
b: mean workpiece width
K: spring constant of mill
ΔP: rolling force variation
ΔS: roll gap variation

26. An interstand tension control method as claimed in claim 15, wherein said torque arm variations $\Delta l_i$ and $\Delta l_{i+1}$ at said i-th and (i+1)th rolling stands respectively are computed according to the equation $$\Delta l = \frac{\lambda^2 R}{2 l_O} (\Delta H + \frac{c}{b} \cdot \Delta P - \Delta h)$$

where
λ: torque arm coefficient
R: roll radius
$l_0$: reference torque arm
ΔH: workpiece thickness variation at rolling stand inlet
c: Hitchcock constant
b: mean workpiece width
ΔP: rolling force variation
Δh: workpiece thickness variation at rolling stand outlet 27. In a tandem rolling mill consisting of a plurality of rolling stands, an interstand tension control apparatus including means for computing the interstand tension on the basis of the outputs of rolling force detecting means and rolling torque detecting means, and controlled variable computing means for computing the deviation of said computed interstand tension from the desired value and applying an interstand tension control compensating signal compensating said deviation to interstand tension regulating means thereby maintaining constant the interstand tension imparted to a workpiece being rolled by said tandem rolling mill, wherein said apparatus further comprises means for detecting more than one of the physical quantities including the workpiece thicknesses at the inlet and outlet of an i-th rolling stand, the rolling force at said i-th rolling stand and the roll gap of said i-th rolling stand, and wherein said interstand tension computing means comprises means for computing the reference torque arm value for said i-th rolling stand and storing the same in a memory after the workpiece is fed into the nip between the rolls of said i-th rolling stand but before the workpiece is fed into the nip between the rolls of an (i+1) rolling stand, means for computing the torque arm value on the basis of said reference torque arm value and the outputs of said detecting means associated with said i-th rolling stand, and means for computing the interstand tension on the basis of said computed torque arm value and the variables which include the detected values of the rolling force and rolling torque.

28. An interstand tension control apparatus as claimed in claim 27, wherein said interstand tension computing means includes means for dividing the total interstand tension by the sectional area of the workpiece to find the unit interstand tension, and said controlled variable computing means computes said interstand tension control compensating signal so as to compensate the deviation of said computed unit interstand tension from the desired unit value.

29. In a tandem rolling mill consisting of a plurality of rolling stands, an interstand tension control apparatus including means for computing the interstand tension on the basis of the outputs of rolling force detecting means and rolling torque detecting means associated with an i-th rolling stand and an (i+1)th rolling stand, and controlled variable computing means for computing the deviation of said computed interstand tension from the desired value and applying an interstand tension control compensating signal compensating said deviation to interstand tension regulating means, wherein said apparatus further comprises means for detecting more than one of the physical quantities including the workpiece thicknesses at the inlet and outlet of said i-th and (i+1)th rolling stands, the rolling forces at said i-th and (i+1) rolling stands, and the rolling torques at said i-th and (i+1) rolling stands, and wherein said interstand tension computing means comprises:

first computing means for computing the reference torque arm value for said i-th rolling mill on the basis of the outputs of said rolling torque detecting means and said rolling force detecting means associated with said i-th rolling stand and storing the same after the workpiece is fed into the nip between the rolls of i-th rolling stand but before the workpiece is fed into the nip between the rolls of said (i+1) th rolling stand;

first memory means for storing the outputs of said physical quantity detecting means associated with said i-th rolling stand as the reference values of physical quantities detected at the time of said computation by said first computing means;

second computing means for computing the reference torque arm value for said (i+1)th rolling stand on the basis of the outputs of said rolling torque detecting means and said rolling force detecting means associated with said (i+1) rolling stand and storing the same immediately after the workpiece is fed into the nip between the rolls of said (i+1)th rolling stand;

second memory means for storing the outputs of said physical quantity detecting means associated with said (i+1)th rolling stand as the reference values of physical quantities detected at the time of said computation by said second computing means;

third computing means for computing the variations of said reference values of physical quantities for said i-th and (i+1)th rolling stands on the basis of the outputs of said physical quantity detecting means while the workpiece is being rolled by said i-th and (i+1)th rolling stands;

fourth computing means for computing the torque arm values at that time on the basis of said variations and said reference torque arm values for said i-th and (i+1)th rolling stands; and fifth computing means for computing the interstand tension on the basis of said computed torque arm values and the outputs appearing at that time from said rolling torque detecting means and said rolling force detecting means associated with said i-th and (i+1)th rolling stands.

30. An interstand tension control apparatus as claimed in claim 29, wherein said interstand tension computing means includes means for dividing the total interstand tension by the sectional area of the workpiece to find the unit interstand tension, and said controlled variable computing means computes said interstand tension control compensating signal so as to compensate the deviation of said computed unit interstand tension from the desired unit value.

* * * * *